US005624138A

United States Patent [19]

Park

[11] Patent Number: 5,624,138

[45] Date of Patent: Apr. 29, 1997

[54] DICTIONARY PROVIDED WITH LETTER INDEXES

[76] Inventor: Sae J. Park, 175-20, Sadang 3-dong,, Dongjak-ku, Seoul, Rep. of Korea, 156-093

[21] Appl. No.: 501,043

[22] PCT Filed: Oct. 8, 1994

[86] PCT No.: PCT/KR94/00135

§ 371 Date: Aug. 16, 1995

§ 102(e) Date: Aug. 16, 1995

[87] PCT Pub. No.: WO95/16573

PCT Pub. Date: Jun. 22, 1995

[30] Foreign Application Priority Data

Dec. 16, 1993 [KR] Rep. of Korea ..... 1993/27992 U

[51] Int. Cl.[6] ..... B42D 1/00; B42F 21/00

[52] U.S. Cl. ..... 283/36; 283/38; 283/41; 283/42; 283/63.1

[58] Field of Search ..... 281/15.1; 283/36–43, 283/63.1; 40/359, 360, 361

[56] References Cited

U.S. PATENT DOCUMENTS

| | | | |
|---|---|---|---|
| 433,223 | 7/1890 | Wells | 283/37 |
| 955,735 | 4/1910 | Wood | 283/37 |
| 2,369,173 | 2/1945 | Oppenheimer | 283/42 |
| 2,616,727 | 11/1952 | Bock, Jr. | 283/42 |
| 2,680,630 | 6/1954 | Machol | 283/38 |
| 4,300,791 | 11/1981 | Bohrer et al. | 283/38 |
| 4,811,974 | 3/1989 | Ho | 283/36 X |
| 4,813,710 | 3/1989 | Weilgart | 283/38 X |
| 4,921,900 | 5/1990 | Feng | 283/38 X |
| 4,927,178 | 5/1990 | Schechter | 283/42 X |
| 4,949,999 | 8/1990 | Ke-Hui | 283/40 X |
| 5,306,048 | 4/1994 | Park . | |

FOREIGN PATENT DOCUMENTS

| | | | |
|---|---|---|---|
| 450832 | 4/1913 | France | 283/42 |
| 957976 | 3/1950 | France | 283/42 |
| 1225131 | 6/1960 | France | 283/42 |
| 2291039A | 6/1976 | France . | |
| 2327105A | 5/1977 | France . | |
| 25422 | 3/1963 | German Dem. Rep. | 283/42 |
| 542155 | 12/1931 | Germany | 283/42 |
| 537695 | 10/1991 | Germany | 283/42 |
| 236476 | 2/1959 | Netherlands | 283/42 |
| 273416 | 2/1951 | Switzerland | 283/42 |
| 58 | of 1876 | United Kingdom | 283/42 |
| 591786 | 9/1947 | United Kingdom . | |
| 654405 | 6/1951 | United Kingdom | 283/42 |
| 90/098895A1 | 9/1980 | WIPO . | |
| 82/03205A1 | 9/1982 | WIPO . | |

*Primary Examiner*—Frances Han

*Attorney, Agent, or Firm*—Shlesinger, Arkwright & Garvey LLP

[57] ABSTRACT

A dictionary provided on inner pages with letter indexes capable of conveniently and rapidly searching for desired words. The dictionary includes a plurality of first letter index blocks indicative of the same letters being arranged at the same positions of the inner pages, respectively, and shaped into the same; a plurality of second letter index blocks including two groups being provided respectively on the front and back sides of each inner page such that their index blocks are arranged in alphabetical order, and ones of the second letter index blocks indicative of the same letters being arranged at the same positions of the inner pages, respectively, and shaped into the same, and the first letter index blocks and one of the second letter index blocks each indicative of the second letter of words recorded on each corresponding inner page, being printed with a depth of color enabling them to be distinguished from the other index blocks.

16 Claims, 5 Drawing Sheets

DICTIONARY PROVIDED WITH LETTER INDEXES

TECHNICAL FIELD

The present invention relates to a dictionary provided with letter indexes, and more particularly to a dictionary provided on each inner page with letter index blocks respectively indexed with first and second letters of a word to be indexed on the inner page, thereby capable of conveniently and rapidly searching the dictionary for a desired word.

BACKGROUND ART

Generally, a dictionary including a number of bound inner pages each recorded with many words is provided with first letter indexes meeting its intrinsic use purpose. For example, index blocks indicative of the same first letter of words recorded on each inner page are provided at front and back sides of the inner page, respectively. The index blocks on the sides of inner pages are arranged such that the same ones indicative of the same letter are positioned at the same level of the inner pages, while different ones indicative of different letters from one another are stepwise positioned in alphabetical order when viewed at one side of the dictionary. Using the first letter indexes, a user can look up a desired word in the dictionary.

Although such a dictionary includes indexes, it encounters problems of a lot of time taken to search the dictionary for desired words and a difficulty in the search because the indexes are only indicative of the first letters of words and numerous words recorded on inner pages include the same first letter.

For example, where a word "STAR" is to be searched for, the index block indicative of the first letter of "STAR", namely, "S" is first looked up from index blocks formed on inner pages in the dictionary. Thereafter, inner pages recorded with words whose second letters are "T" are looked up while turning over left and right the inner pages recorded with words whose first letters are "S". Subsequently, an inner page or inner pages recorded with words whose third words are "A" are looked up. Finally, the inner page recorded with the word "STAR" whose fourth word is "R" is looked up. Accordingly, there are problems of a lot of time and effort to search for words.

Meanwhile, the applicant has proposed an atlas provided with colored indexes capable of rapidly looking up a map of a desired place. This atlas is disclosed in U.S. Pat. No. 5,306,048 issued on Apr. 26, 1994.

The atlas is provided with index blocks recorded with place names of maps on front and back sides of its inner pages. Index blocks indicative of the same place name are printed with the same color, while adjacent index blocks on each inner page are printed with different colors from each other. Index block indicative of the map name of each inner page is printed with a color darker than those of other index blocks on the inner page. With such index blocks, it is possible to search for a map of a desired place conveniently and rapidly.

However, since the patent relates to an atlas provided with index blocks indicative of specified place name, it can not be applied to a dictionary recorded with words which are numerous combinations of same and different alphabet letters. Where index blocks of the dictionary including a number of bound inner pages are printed with different colors, as in the above-mentioned patent, there are problems of a greatly increased print cost and a complex printing process.

DISCLOSURE OF THE INVENTION

Therefore, an object of the invention is to solve the above-mentioned problems encountered in the prior art and, thus, to provide a dictionary provided with letter indexes capable of conveniently and rapidly searching for desired words, the letter indexes including first letter index blocks and second letter index blocks provided at inner pages such that they are arranged in alphabetical order, thereby rapidly looking up inner pages recorded with words bearing the same first and second letters as those of a word to be searched for.

Another object of the invention is to provide a dictionary provided with letter indexes capable of conveniently and rapidly searching for desired words while reducing the print cost, the letter indexes including first letter index blocks and second letter index blocks provided at inner pages and printed with the same color, but such that ones of the second letter index blocks, each indicative of the same second letter of words recorded on each corresponding inner page, are printed with a depth of color enabling them to be distinguished from other index blocks.

In accordance with the present invention, this object can be accomplished by providing a dictionary including a plurality of bound inner pages each recorded at its front and back sides with a number of words, comprising: a plurality of first letter index blocks respectively provided at the front and back sides of the inner pages and indicative of the same first letters of words recorded on the front and back sides of the inner pages, the same ones of the first letter index blocks indicative of the same letters being arranged at the same positions of the inner pages, respectively, and shaped into the same shape; a plurality of second letter index blocks including two groups, one of the groups being provided at the front side of each inner page such that its index blocks are arranged in alphabetical order and indicative of the first letter of an alphabet to the same second letter of words recorded on the front side of the inner page, the other group being provided at the back side of each inner page such that its index blocks are arranged in alphabetical order and indicative of the same second letter of words recorded on the back side of the inner page to the last letter of the alphabet, and the same ones of the second letter index blocks indicative of the same letters being arranged at the same positions of the inner pages, respectively, and shaped into the same shape; and the first letter index blocks and ones of the second letter index blocks, each indicative of the same second letter of words recorded on each corresponding inner page, being printed with a depth of color enabling them to be distinguished from other index blocks.

BRIEF DESCRIPTION OF THE DRAWINGS

The above and other objects, features and advantages of the present invention will be more clearly understood from the following detailed description taken in conjunction with the accompanying drawings, in which.

MODE FOR CARRING OUT THE INVENTION

Figure 1:
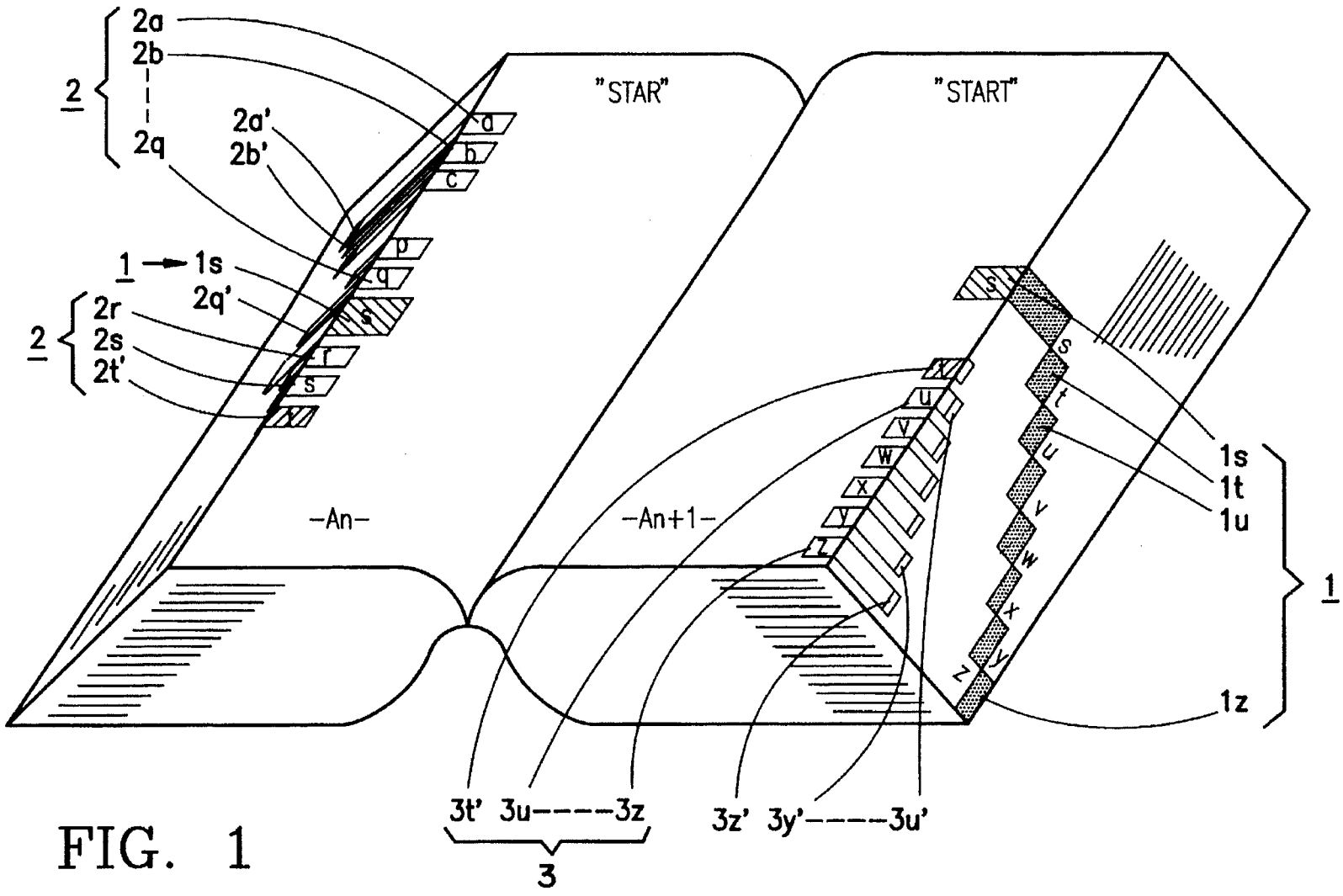
FIG. 1 is a perspective view of a dictionary including inner pages provided with indexes in accordance with a first embodiment of the present invention, showing opened conditions of $A_n$-th and $A_{n+1}$-th pages of the dictionary.

FIG. 1 is a perspective view of a dictionary including inner pages provided with indexes in accordance with a first embodiment of the present invention, showing opened conditions of $A_n$-th and $A_{n+1}$-th pages of the dictionary. On the other hand, FIG. 2 is a plan view of the opened $A_n$-th and $A_{n+1}$-th pages of the dictionary shown in FIG. 1.

Figure 2:
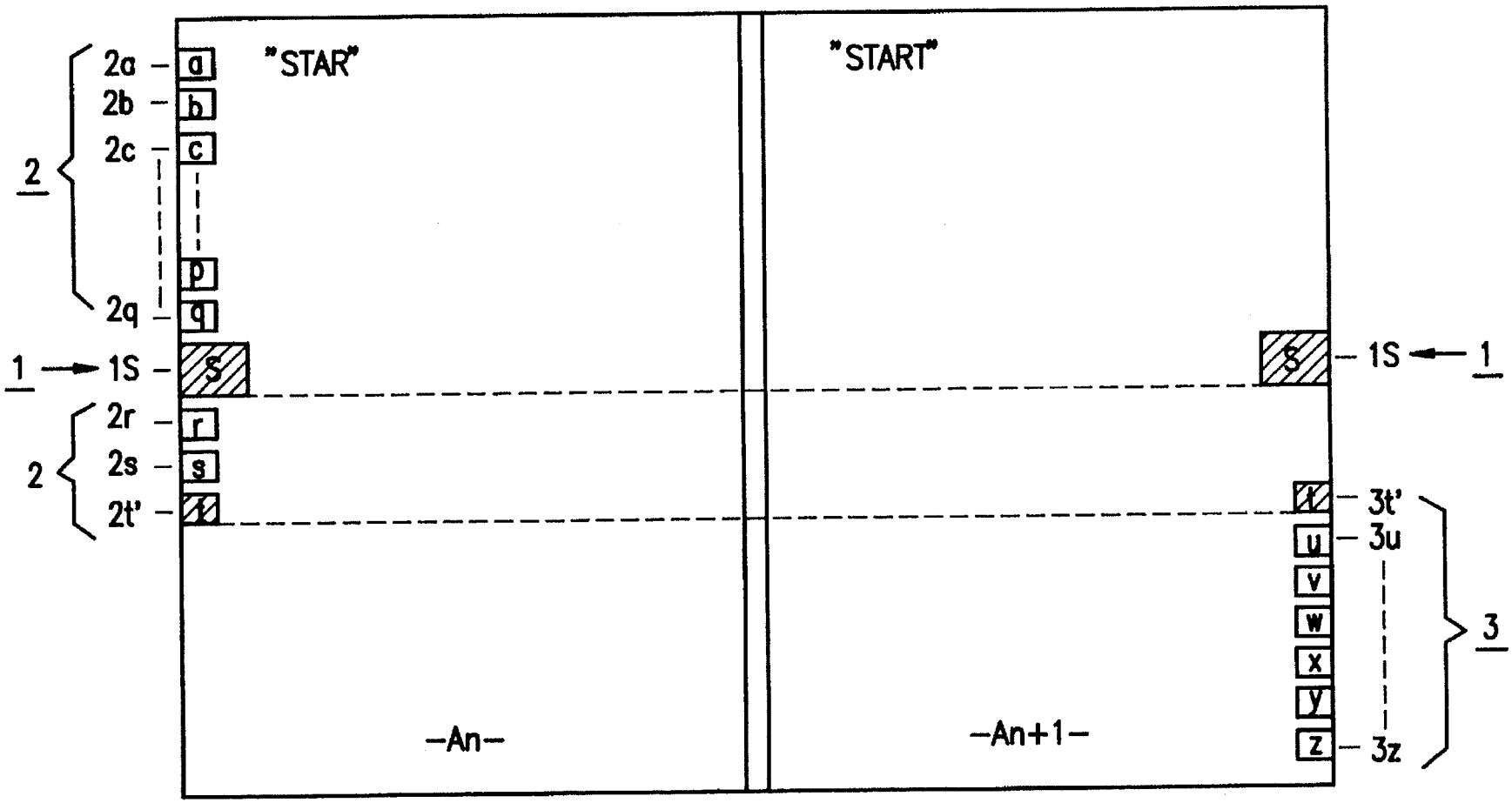
FIG. 2 is a plan view of the opened $A_n$-th and $A_{n+1}$-th pages of the dictionary shown in FIG. 1.

In FIGS. 1 and 2, the words "STAR" and "START" represents the first ones of words recorded on the $A_n$-th and $A_{n+1}$-th pages, respectively. In the dictionary, words recorded on the left portion of each page precede words recorded on the right portion, in view of the letter arrangement. Hereinafter, when the dictionary is opened, one side recorded with words preceding words is referred to as "front side", while the other side referred to as "back side". Such a page, inclusive of both sides is referred to as "inner page". Accordingly, the $A_n$-th page corresponds to the front side of its corresponding inner page whereas the $A_{n+1}$-th page corresponds to the back side of its corresponding inner page.

The inner pages are provided at their side edges with first letter index blocks 1, namely, 1*s* to 1*z* indicative of the first letters of words recorded on the inner pages, respectively, as in the conventional dictionary. The different index blocks 1*s* to 1*z* are arranged such that they form stepped layers when viewed at one side of the dictionary. Each of the inner pages is also provided at its side edge with second letter index blocks 2 or 3 indicative of the second letters of words. In FIG. 1, the second letter index blocks of only the inner pages including the first letter index blocks 1 indicative of "S" are shown at one side of the dictionary, for the simplicity of the illustration.

The second letter index blocks 2 provided at the front side of each inner page are indicative of the first letter "a" of alphabet to the second letter of words recorded on the front side of the inner page, respectively. The second letter index blocks 2 are vertically arranged in alphabetical order. On the other hand, the second letter index blocks 3 provided at the back side of each inner page are indicative of the second letter of words recorded on the back side of the inner page to the last letter "z" of alphabet, respectively. In similar to the second letter index blocks 2, the second letter index blocks 3 are vertically arranged in alphabetical order.

In the case of the $A_n$-th page being the front side of its inner page and recorded with words whose first and second letters are "S" and "T", respectively, it has the first letter index block 1*s* indicative of "S" and second letter index blocks 2*a*, 2*b*, . . . , 2*s*, and 2*t'* respectively indicative of the first letter "a" of alphabet to the second letter "t" of the word "STAR" recorded on the $A_n$-th page and vertically arranged in alphabetical order. On the other hand, in the case of the $A_{n+1}$-th page being the back side of its inner page and recorded with words whose first and second letters are "S" and "T", respectively, it has the first letter index block 1*s* indicative of "S" and second letter index blocks 3*t'*, 3*u*, . . . , and 3*z* respectively indicative of the second letter "t" of the word "START" recorded on the $A_{n+1}$-th page to the last letter "z" of alphabet and vertically arranged in alphabetical order.

The first index blocks 1 and the second letter index blocks 2*a'*, 2*b'*, . . . , and 2*z'* respectively indicative of second letters of words recorded on inner pages are printed with a deeper color than other index blocks recorded on the same inner pages so that they can be distinguished from the other index blocks. For example, both the first letter index block 1*s* on the $A_n$-th page and the second letter index block 2*t'* indicative of the second letter "t" of the word "STAR" on the $A_n$-th page have a deeper color than other index blocks 2*a*, 2*b*, . . . , and 2*s* on the same page.

The first letter index blocks on the sides of inner pages bearing the same first letter are arranged such that they are positioned at the same positions of the inner pages, respectively, and shaped into the same shape. Accordingly, the same first letter index blocks are arranged such that they are aligned with one another when viewed at one side of the dictionary. In similar, the second letter index blocks on the sides of inner pages bearing the same second letter are arranged such that they are positioned at the same positions of the inner pages, respectively, and shaped into the same shape. Accordingly, the same second letter index blocks are arranged such that they are aligned with one another when viewed at one side of the dictionary.

For example, the first letter index blocks 1*s* on the inner pages recorded with words whose first letter is "S" are arranged such that they are positioned at the same positions of the inner pages, respectively, and shaped into the same shape. Accordingly, the first letter index blocks 1*s* are arranged such that they are aligned with one another when viewed at one side of the dictionary. Also, the second letter index blocks 2*a*, indicative of "a", on the inner pages are arranged such that they are positioned at the same positions of the inner pages, respectively, and shaped into the same shape. Accordingly, the second letter index blocks 2*a* are arranged such that they are aligned with one another when viewed at one side of the dictionary.

Now, function and effect of the dictionary having the above-mentioned construction will be described.

Where a word "SAINT" whose first and second words are "S" and "A", respectively, is to be looked up in the dictionary, a line of the first letter index blocks 1*s* indicative of "S" is first looked up from lines of the first letter index blocks 1 at one side of the dictionary to open the inner pages of the dictionary provided with the first letter index blocks 1*s*, as in the conventional dictionary. If $A_n$-th and $A_{n+1}$-th pages of the dictionary are opened, then the deeply-printed second letter index block 2*a'* is looked up from a line of the second letter index blocks 2*a*, indicative of "a", downwardly extending along the side of the dictionary. Thereafter, the inner page of the dictionary provided with the deeply-printed second letter index block 2*a'* is opened. Since the inner page opened is recorded with words whose first and second words are "S" and "A", respectively, the word "SAINT" can be looked up conveniently and rapidly. Where a word "SUN" is also searched for, it can be looked up by looking up the deeply-printed second letter index block 3*u'* from a line of the second letter index blocks 3*u* indicative of "u" and opening the inner page provided with the deeply-printed second letter index blocks 3*u'*.

Figure 3:
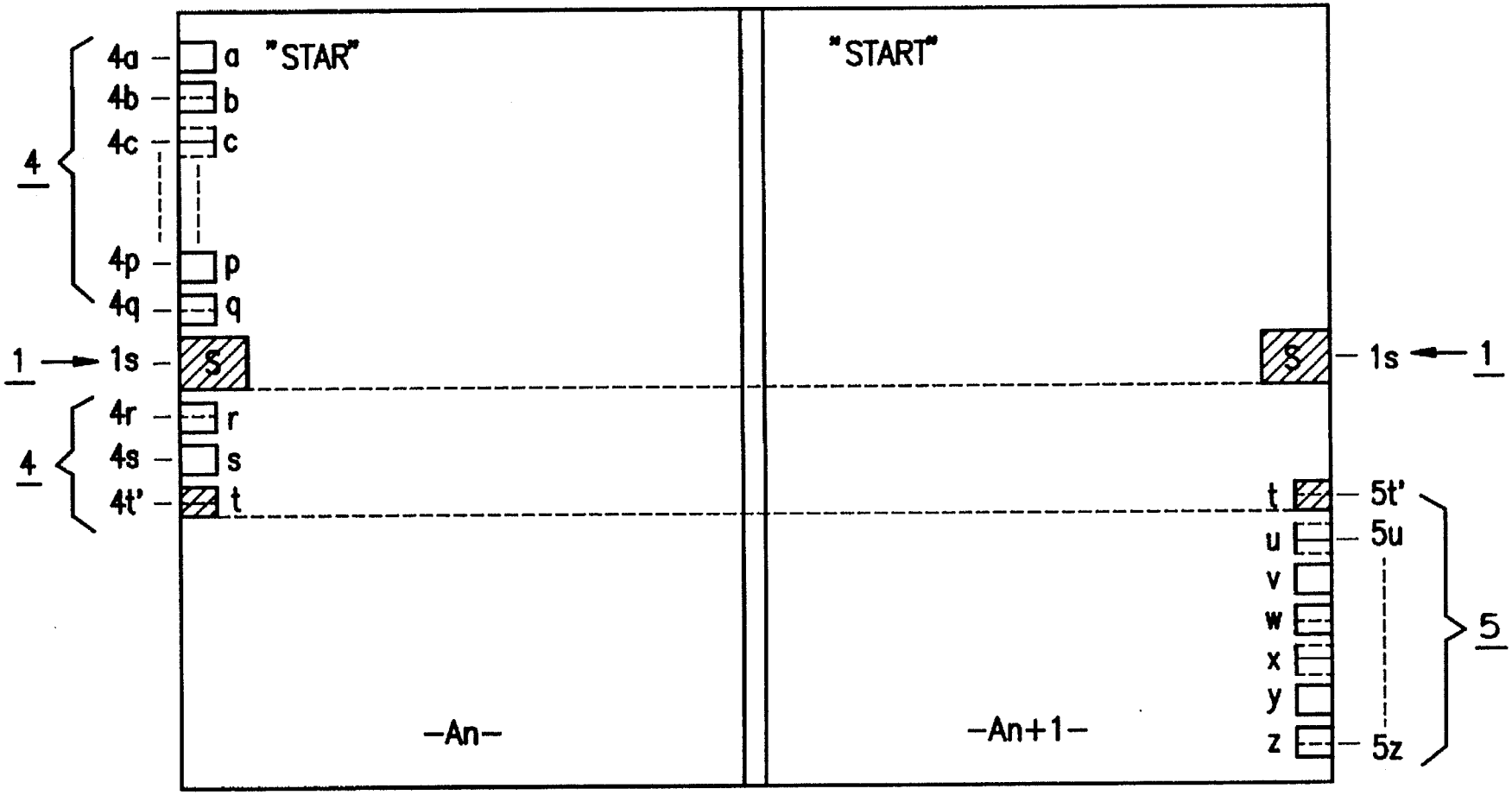
FIG. 3 is a plan view a dictionary including inner pages provided with indexes in accordance with a second embodiment of the present invention.

FIG. 3 is a plan view a dictionary including inner pages provided with indexes in accordance with a second embodiment of the present invention, showing opened conditions of $A_n$-th and $A_{n+1}$-th pages of the dictionary.

In accordance with the second embodiment, the dictionary includes second letter index blocks having different shapes. In this case, second letter index blocks arranged adjacent to each other when viewed at the side of the dictionary can be easily distinguished from each other even where the dictionary includes inner pages bound to be slightly distorted. Accordingly, it is possible to more conveniently look up an inner page or inner pages recorded with the second letter of a word to be searched for. In other words, vertically adjacent ones of second letter index blocks 4 and 5 which have the same functions as the second letter index blocks 2 and 3 of the first embodiment, respectively, have different shapes from each other in accordance with the second embodiment. For example, such adjacent second letter index blocks may be 4*a* and 4*b* or 4*b* and 4*c* in FIG. 3. In accordance with the second embodiment, the adjacent ones of the second letter index blocks 4 and 5 may be printed with different depths of color so that they can be more clearly distinguished from each other.

Other constructions of the dictionary in accordance with the second embodiment are the same as those of the dictionary in accordance with the first embodiment and, thus, description thereof is omitted.

Figure 4:
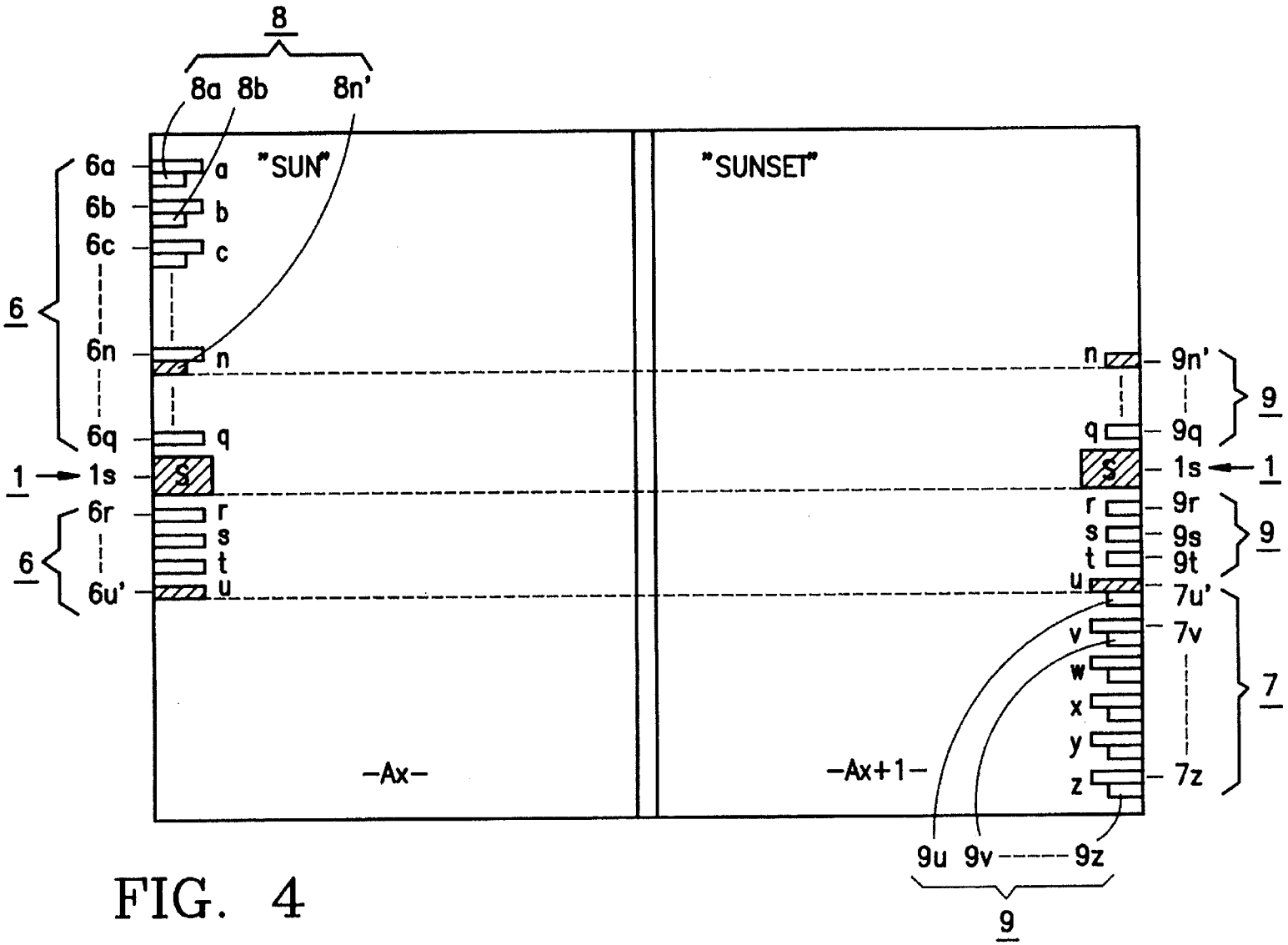
FIG. 4 is a plan view a dictionary including inner pages provided with indexes in accordance with a third embodiment of the present invention.

FIG. 4 is a plan view a dictionary including inner pages provided with indexes in accordance with a third embodiment of the present invention, showing opened conditions of $A_x$-th and $A_{x+1}$-th pages of the dictionary. The $A_x$-th and $A_{x+1}$-th pages bear words "SUN" and "SUNSET" as the first ones of words recorded thereon, respectively. In accordance with the third embodiment, the $A_x$-th and $A_{x+1}$-th pages have first letter index blocks 1 and second letter index blocks 6 and 7 which have the same functions as the second letter index blocks 2 and 3 of the first embodiment, respectively. As different from the first and second embodiments, the $A_x$-th and $A_{x+1}$-th pages have third letter index blocks 8 and 9, respectively, in accordance with the third embodiment.

The third letter index blocks 8 provided at the $A_x$-th page which is the front side of its inner page are indicative of the first letter "a" of alphabet to the third letter "n" of the word "SUN" recorded on the $A_x$-th page respectively. The third letter index blocks 8 are vertically arranged in alphabetical order. On the other hand, the third letter index blocks 9 provided at the $A_{x+1}$-th page which is the back side of its inner page are indicative of the third letter of the word "SUNSET" recorded on the $A_{x+1}$-th page to the last letter "z" of alphabet, respectively. In similar to the third letter index blocks 8, the third letter index blocks 9 are vertically arranged in alphabetical order.

Among the third letter index blocks 8 and 9 respectively provided at the front and back sides of each inner page, ones indicative of the same letters as those of the second letter index blocks provided at the inner page are positioned beneath the corresponding second letter index blocks, respectively. In the case of the $A_x$-th page, the third letter index blocks 8*a*, 8*b*, . . . , and 8*n*' are positioned beneath the second letter index blocks 6*a*, 6*b*, . . . , and 6*n*, respectively. In the case of the $A_{x+1}$-th page, the third letter index blocks 9*u*, 9*v*, . . . , and 9*z* are positioned beneath the second letter index blocks 7*u*', 7*v*, . . . , and 7*z*, respectively. Among the third letter index blocks 8 and 9 provided at each inner page, ones indicative of letters different from those of the second letter index blocks provided at the inner page are positioned independently. In the case of the $A_x$-th page, there is no independent third letter index block. The $A_{x+1}$-th page bears independent third letter index blocks 9*n*', . . . , and 9*t*. Third letter index blocks, indicative of the same third letter, on inner pages recorded with the same first letter are arranged such that they are positioned at the same positions of the inner pages, respectively, and shaped into the same shape. The third letter index block indicative of the same third letter of words recorded on its inner page is printed with a deeper color than other index blocks recorded on the inner page. For example, the third letter index block 8*n*' indicative of the third letter "n" of the word "SUN" on the $A_x$-th page has a deeper color than other index blocks on the same page.

In accordance with the third embodiment of the present invention, therefore, it is possible to conveniently and rapidly look up a desired word in the dictionary up to its third letter.

Figure 5:
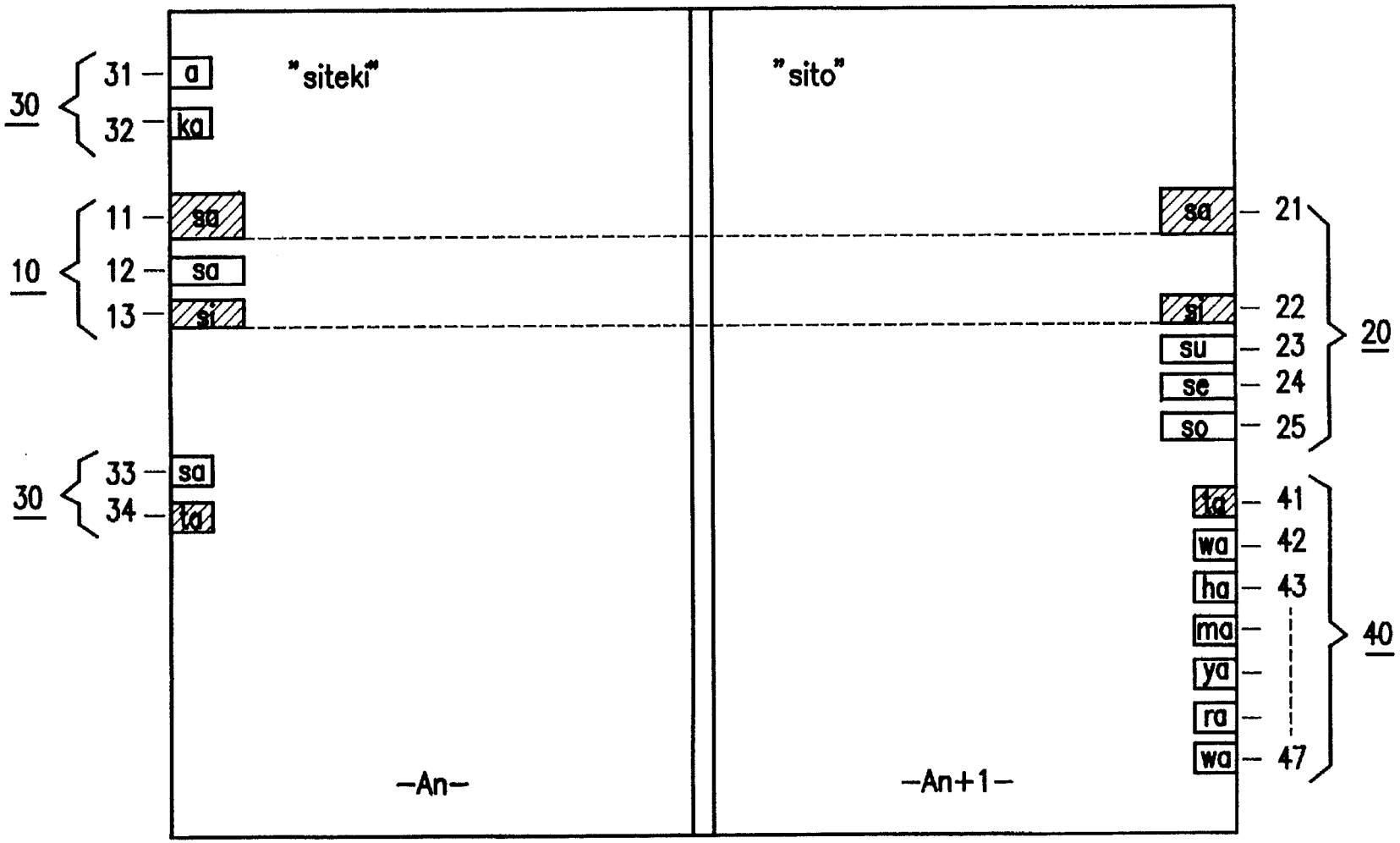
FIG. 5 is a plan view a dictionary including inner pages provided with indexes in accordance with a fourth embodiment of the present invention.

FIG. 5 is a plan view a dictionary including inner pages provided with indexes in accordance with a fourth embodiment of the present invention, showing opened conditions of $A_n$'-th and $A_{n+1}$'-th pages of the dictionary.

The fourth embodiment is concerned with dictionaries for words of language systems other than that of the English language. In the illustrated case, this embodiment is concerned with a dictionary for the Japanese language in which a consonant and a vowel are combined to constitute an alphabetic letter. In the following table, pronunciations of letters constituting the alphabet of the Japanese language are expressed by the Roman letters.

TABLE

| Column | 1 | 2 | 3 | 4 | 5 | 6 | 7 | 8 | 9 | 10 |
|---|---|---|---|---|---|---|---|---|---|---|
| Letter | a | ka | sa | ta | na | ha | ma | ya | ra | wa |
| | i | ki | si | ti | ni | hi | mi | . | ri | . |
| | u | ku | su | tu | nu | hu | mu | yu | ru | . |
| | e | ke | se | te | ne | he | me | . | re | . |
| | o | ko | so | to | no | ho | mo | yo | ro | wo |

The alphabetic order of the Japanese letters is established by the order expressed in the above table. That is, the Japanese letters are arranged in the order from the first, leftmost column of the table to the last, rightmost column and from the first, uppermost letter of each column to the last, lowermost letter. The vertically arranged letters in each column of the table bear the same consonant. Although each of the letters arranged in the first column is constituted only by a vowel, it is regarded as bearing a consonant which is a voiceless sound, herein.

Where index blocks indicative of letters of the Japanese alphabet are provided at a Japanese dictionary in a manner as described in the first to third embodiments, they are not only very complex in construction, but also very small in size, thereby causing the search for words to be rather difficult. This is because the Japanese language have a number of alphabetic letters, as shown in the above table.

Therefore, the fourth embodiment of the present invention is adapted to solve the above-mentioned problem. In FIG. 5, $A_n$'-th and $A_{n+1}$'-th pages of the dictionary in accordance with the fourth embodiment of the present invention are shown. Letters provided at the $A_n$'-th and $A_{n+1}$'-th pages are Roman letters spelling pronunciations of the Japanese letters, respectively. Hereinafter, it is regarded that pronunciations of the Roman letters express Japanese letters directly, for convenience' sake. In accordance with the fourth embodiment, each inner page of the dictionary is provided at its front and rear sides with first words printed in a large size, respectively. For example, the $A_n$'-th and $A_{n+1}$'-th pages bear Japanese words "Siteki" and "Sito" as the first ones of words recorded thereon, respectively. In the Japanese word "Siteki", the letter "Si" is the first letter of the Japanese word, the letter "te" the second letter of the Japanese word, and the letter "ki" the third letter of the Japanese word. That is, the word "Siteki" is composed of the three Japanese letters. In the Japanese word "Sito", the letter "Si" is the first letter of the Japanese word whereas the letter "to" is the second letter of the Japanese word. That is, the word "Sito" is composed of the two Japanese letters. Each inner page is also provided at its front and back sides respectively with first letter index blocks 10 and 20 indicative of letters in the column of the above table, to which the same first letter of words recorded on the pages belongs. The first letter index blocks 10 and 20 include index blocks 11 and 21 indicative of a representative one, namely, the precedentmost one of letters in the column, respectively. For the $A_n$'-th and $A_{n+1}$'-th pages, the index blocks 11 and 21 are indicative of the letter "sa" in the third column to which the same first letter "si" of words recorded on the pages belongs.

The first letter index blocks 10 provided at the front side of each inner page also include index blocks respectively indicative of the letter expressed by the index block 11 to the same first letter of words recorded on the front side of the inner page. The index blocks are vertically arranged in alphabetical order. For the $A_n$'-th page, the first letter index blocks 10 include index blocks 12 and 13 respectively indicative of the letter "sa" expressed by the index block 11 and the same first letter "si" of words recorded on the $A_n$'-th page.

The first letter index blocks 20 provided at the back side of each inner page also include index blocks respectively indicative of the same first letter of words recorded on the back side of the inner page to the last letter in the column to which the same first letter of words recorded on the pages belongs. The index blocks are vertically arranged in alphabetical order. For the $A_{n+1}$'-th page, the first letter index blocks 20 include index blocks 22 to 25 respectively indicative of the same first letter "si" of words recorded on the $A_{n+1}$'-th page to the last letter "so" in the third column to which the same first letter "si" of words recorded on the $A_{n+1}$'-th page belongs.

Each inner page is also provided at its front and back sides respectively with second letter index blocks 30 and 40 indicative of representative letters in the columns of the table. For example, index blocks 31 to 34 provided as the second letter index blocks 30 at the $A_n$'-th page are indicative of the first letter "a" in the first column to the first letter "ta" in the fourth column to which the second letter "te" of the word "Siteki" recorded on the $A_n$'-th page belongs. These second letter index blocks 31 to 34 are vertically arranged in alphabetical order. On the other hand, index blocks 41 to 47 provided as the second letter index blocks 40 at the $A_{n+1}$'-th page are indicative of the first letter "ta" in the fourth column to which the second letter "to" of the word "Sito" recorded on the $A_{n+1}$'-th page belongs to the first letter "wa" in the last column. These second letter index blocks 41 to 47 are vertically arranged in alphabetical order.

The index blocks on the sides of inner pages bearing the same letter are arranged such that they are positioned at the same positions of the inner pages, respectively, and thereby aligned with one another when viewed at the side of the dictionary, as shown in FIG. 1. The first index blocks respectively indicative of the first letters of words recorded on inner pages and the second letter index blocks respectively indicative of the representative letters in the columns to which the second letters of words recorded on inner pages belong are printed with a deeper color than other index blocks recorded on the same inner pages.

For example, both the first letter index block 13 indicative of the first letter "si" of the word "siteki" on the $A_n$-th page and the second letter index block 34 indicative of the representative letter "ta" of the fourth column to which the second letter "te" of the word "siteki" belongs have a deeper color than other index blocks on the same page.

Where a word "Siteki" is to be looked up in the dictionary constructed in accordance with the fourth embodiment, the first letter index blocks 11 indicative of the representative letter "sa" in the third column of the table to which the first letter "si" of the word to be looked up belongs is first looked up at the side of the dictionary to open an optional one of the inner pages of the dictionary provided with the first letter index blocks 11. Thereafter, the inner pages provided with the deeply-printed one of the first letter index blocks 13 indicative of "si" are looked up to open an optional one thereof. In the opened inner page, words whose first letters are "si" are found. Subsequently, the inner page provided with the deeply-printed one of the second letter index blocks 34 indicative of the letter "ta" in the fourth column of the table to which the second letter "te" of the word "siteki" belongs is looked up and then opened. Since the opened inner page is recorded with words whose second words belong to the fourth column of the table, the word "siteki" can be looked up conveniently and rapidly. Thus, an inner page recorded with a word to be searched for can be looked up conveniently and rapidly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Although the present invention has been described as being applied to dictionaries, it may be applied to books recorded with numerous words or names, each composed of a combination of alphabet letters, in alphabetical order. For example, the present invention may be applied to a telephone book.

I claim:

1. A dictionary, comprising:

a) a plurality of inner pages having front and back sides with words recorded thereon, said inner pages being grouped into a number of sets, each inner page in each set having words recorded thereon with the same first letter;

b) each front and back sides of each inner page in each set including a first letter index block indicative of the first letter, said first letter index block being disposed adjacent an outer edge of said front and back sides, each of said first letter index blocks indicative of the same letter being vertically aligned on top of each other when said dictionary is closed;

c) each front side of each inner page in each set including a first plurality of second letter index blocks indicative of the second letter of the words recorded in the set, said first plurality of second letter index blocks being arranged in alphabetical order, starting with the first letter of an alphabet to an intermediate letter of the alphabet corresponding to the second letter of the words on said front side, said first plurality of second letter index blocks being disposed adjacent the outer edge of said front side;

d) each back side of each inner page in each set including a second plurality of second letter index blocks indicative of the second letter of the words recorded in the set, said second plurality of second letter index blocks being arranged in alphabetical order, starting with a letter corresponding to the second letter of the words on said back side to the last letter of the alphabet, said second plurality of second letter index blocks being disposed adjacent the outer edge of said back side; and e) each of said second letter index blocks indicative of the same letter being aligned vertically on top of each other when said dictionary is closed.

2. A dictionary as in claim 1, wherein:

a) each of said first letter index blocks in each set includes a color different from the other first letter index blocks in the other sets.

3. A dictionary as in claim 1, wherein:

a) each second letter index block corresponding to the second letter of the words recorded on said front and back sides includes a color different from the other second letter index blocks on the same front or back side.

4. A dictionary as in claim 1, wherein:

a) said first letter index blocks have substantially the same shape.

5. A dictionary as in claim 1, wherein:

a) said second letter index blocks have substantially the same shape.

6. A dictionary as in claim 1, wherein:

a) said first letter index blocks are shaped differently from said second letter index blocks.

7. A dictionary as in claim 1, wherein:

a) adjacent second letter index blocks disposed on each front and back sides have different shapes from each other.

8. A dictionary for an alphabet having groups of letters, the letters in a group being arranged in order from a representative letter to a last letter, said dictionary comprising:

a) a plurality of inner pages having front and back sides with words recorded thereon, said inner pages being grouped into a number of sets corresponding to the number of groups of letters, each inner page in a set having words recorded thereon with the same first letter corresponding to the representative letter and the other letters of the group;

b) each front and back sides of each inner page in each set including a first letter index block indicative of the representative letter of the group, said first letter index block being disposed adjacent an outer edge of said front and back sides, said first letter index blocks indicative of the same representative letter in the group being vertically aligned on top of each other when said dictionary is closed;

c) each front side of each inner page in each set including a first plurality of first letter index blocks indicative of the letters in the group and indicative of the first letter of the words recorded in the set, said first plurality of first letter index blocks being arranged in alphabetical order, starting with the representative letter to an intermediate letter of the group corresponding to the first letter of the words on said front side, said first plurality of first letter index blocks being diposed adjacent the outer edge of said front side;

d) each back side of each inner page in each set including a second plurality of first letter index blocks indicative of the letters in the group and indicative of the first letter of the words recorded in the set, said second plurality of first letter index blocks being arranged in alphabetical order, starting with a letter corresponding to the first letter of the words on said back side to the last letter of the group, said second plurality of first letter index blocks being diposed adjacent the outer edge of said back side;

e) each of said first letter index blocks indicative of the same letter in the group being aligned vertically on top of each other when said dictionary is closed;

f) each front side of each inner page in each set including a first plurality of second letter index blocks indicative of the representative letters and indicative of the second letter of the words recorded in the set, said first plurality of second letter index blocks being arranged in alphabetical order, starting with the first representative letter of the alphabet to an intermediate representative letter of the alphabet corresponding to the second letter of the words on said front side, said first plurality of second letter index blocks being diposed adjacent the outer edge of said front side; and g) each back side of each inner page in each set including a second plurality of second letter index blocks indicative of the representative letters and indicative of the second letter of the words recorded in the set, said second plurality of second letter index blocks being arranged in alphabetical order, starting with a representative letter corresponding to the second letter of the words on said back side to the last representative letter of the alphabet, said second plurality of second letter index blocks being diposed adjacent the outer edge of said back side.

9. A dictionary as in claim 8, wherein:

a) said first letter index blocks corresponding to the representative letter in a group have substantially the same shape.

10. A dictionary as in claim 8, wherein:

a) said first letter index blocks corresponding to the letters in the group have substantially the same shape.

11. A dictionary as in claim 8, wherein:

a) said first letter index blocks are shaped differently from said second letter index blocks.

12. A dictionary as in claim 8, wherein:

a) said first letter index blocks indicative of the representative letter in a group are shaped differently from said first letter index blocks indicative of the letters in the group.

13. A dictionary as in claim 8, wherein;

a) said second letter index blocks indicative of the same representative letters have substantially the same shape.

14. A dictionary as in claim 8, wherein:

a) said first letter index blocks corresponding to the first letter of the words recorded on said front and back sides include a color different from the other first letter index blocks on the same front or back side.

15. A dictionary as in claim 8, wherein:

a) said second letter index blocks corresponding to the second letter of the words recorded on said front and back sides include a color different from the other second letter index blocks on the same front or back side.

16. A dictionary as in claim 8, wherein:

a) said second letter index blocks have substantially the same shape.

* * * * *